US006440273B1

(12) United States Patent
Jewitt

(10) Patent No.: US 6,440,273 B1
(45) Date of Patent: Aug. 27, 2002

(54) COMPACT MULTILEVEL PAPER MAKING MACHINE FOR MANUFACTURING A WEB OF PAPER

(75) Inventor: Dennis E. Jewitt, Kent (GB)

(73) Assignee: Metso Paper Karlstad Aktiebolag (AB), Karlstad (SE)

( * ) Notice: Subject to any disclaimer, the term of this patent is extended or adjusted under 35 U.S.C. 154(b) by 0 days.

(21) Appl. No.: 09/464,994

(22) Filed: Dec. 16, 1999

(51) Int. Cl.[7] ..... D21F 9/00

(52) U.S. Cl. ..... 162/290; 34/116; 34/123; 162/301; 162/359.1

(58) Field of Search ..... 162/290, 306, 162/359.1, 375, 301; 34/116, 123

(56) References Cited

U.S. PATENT DOCUMENTS

| | | | | |
|---|---|---|---|---|
| 3,531,371 A | | 9/1970 | Jordansson et al. | |
| 3,846,228 A | | 11/1974 | Ely et al. | |
| 3,868,780 A | * | 3/1975 | Soininen et al. | 34/116 |
| 3,985,612 A | * | 10/1976 | Watanabe | 162/306 |
| 4,008,122 A | | 2/1977 | Welte | |
| 4,036,684 A | * | 7/1977 | Schmitt et al. | 162/306 |
| 4,102,737 A | * | 7/1978 | Morton | 162/301 |
| 4,911,791 A | | 3/1990 | Mokvist | |
| 5,590,476 A | * | 1/1997 | Alakoski et al. | 34/116 |

* cited by examiner

*Primary Examiner*—Karen M. Hastings
(74) *Attorney, Agent, or Firm*—Alston & Bird LLP

(57) ABSTRACT

A compact multilevel paper making machine is provided comprising a web-receiving region where a web of paper is received on a fabric forming a continuous loop, a reel-up for winding the paper web onto a roll, and a web transfer point disposed between the web-receiving region and the reel-up. The fabric receives the web at the web-receiving region and then supports and transports the web from the web-receiving region to the web transfer point in a first direction on a first defined vertical level. At the web transfer point, the web is separated from the fabric. The fabric loop further includes a return run from the web transfer point to the web-receiving region over which the fabric then travels. A cleaning section is also disposed along the return run of the fabric loop for cleaning the fabric. Following separation from the fabric, the web is transported to the reel-up in a second direction, generally opposite to the first direction, and on a second defined vertical level different from the first defined vertical level. The second defined vertical level may be either above or below the first defined vertical level, wherein a defined vertical level may comprise, for instance, a floor of a building. Dryers are also provided before and/or after the web transfer region for drying the web and are accordingly disposed on the different defined vertical levels. Thus, by configuring the paper making machine to transport the web between different defined vertical levels, a compact multi-level paper making machine having a small footprint is provided for limited-space installations.

9 Claims, 7 Drawing Sheets

COMPACT MULTILEVEL PAPER MAKING MACHINE FOR MANUFACTURING A WEB OF PAPER

FIELD OF THE INVENTION

The present invention relates to paper making machines and, more particularly, to a compact multilevel paper making machine for manufacturing a web of paper.

BACKGROUND OF THE INVENTION

Generally, in a paper making machine, a wet paper web is formed in a former on a forming fabric and then moved downstream. Further, as the web is transported downstream in the paper making machine with a drying fabric, it is processed through a dewatering and/or a drying section where it is dewatered and/or dried, respectively. In some configurations of paper making machines, the forming fabric may also comprise the drying fabric. In alternate configurations of paper making machines, the drying fabric may be a separate fabric from the forming fabric, wherein the paper web is formed on the forming fabric and then transferred therefrom to the drying fabric for transportation through the dewatering and/or the drying section. Thus, references herein to a web-receiving region are intended to include the above-described configurations for the paper web being received by the drying fabric.

The drying section may include, for example, one or more of a through-air dryer (TAD), an infrared dryer, an impingement dryer, a cylindrical contact dryer, or the like. The paper making machine may further provide for additional drying of the web with another drying section comprising, for instance, a Yankee dryer. In this configuration, the web and fabric are passed downstream through a nip where the web is transferred to the Yankee dryer from the fabric. Generally, where a Yankee dryer follows the dryers in the upstream section, the dryers in the upstream section are regarded as pre-dryers for partially drying the paper web. These pre-dryers may further be regarded as comprising a part of the drying section or collectively forming a separate pre-drying section. Where the paper making machine includes a pre-drying section and a Yankee dryer, the Yankee dryer is accordingly regarded as the final dryer for drying the paper web. However, where the paper making machine does not include a Yankee dryer, the dryers in the upstream section comprise the final dryers for drying the paper web. Thus references herein to a drying section are intended to include either of the above configurations with regard to the definitions of a drying section and a pre-drying section. After final drying of the paper web, the web is directed to a reel-up where it is wound onto a spool to form a finished roll of paper.

As the paper web proceeds from the web-receiving region to the final dryer, the processes therebetween often leave residue from the paper web on the fabric or fabrics used to transport the paper web through the paper making machine. Thus, for proper operation of the paper making machine, the web-carrying fabrics are passed through a cleaning section before they return to the web-receiving region.

A paper making machine thus generally comprises one or more fabrics carrying a paper web, a drying section where the web is dried by one or more dryers, a cleaning section where the fabric is cleaned before returning to a web-receiving region, and a reel-up for receiving the dried paper web and winding it onto a spool. The paper making process is typically accomplished by having the pre-drying and/or drying section and the reel-up all disposed on essentially the same vertical level, with the web processing generally along a single direction from one end of the machine where it enters the pre-drying or drying section, to the other end where it is wound onto the roll in the reel-up. Where a Yankee dryer is used for final drying in a paper making machine, the rotations of the loop and the Yankee dryer (which is a rotatable drying cylinder) are coordinated such that the web is transferred to the Yankee dryer and carried over the top thereof in an upright orientation before being creped by the doctor blade. Creping the web in an upright orientation requires the web leaving the dewatering or the pre-drying section to encounter an upwardly moving surface of the Yankee dryer at the nip. Once dried by the Yankee dryer and creped, the dried web is transported to the reel-up to be wound onto a spool.

Prior art paper making machines exhibit some disadvantages resulting from the basic layout described. For example, in the typical configuration of a paper making machine, the machine occupies a large footprint because the web is transported from the web-receiving region, through the pre-drying section, onto the Yankee dryer, and to the reel-up, all in the same general direction and normally on a single floor or level. That is, the required machine hall length of a typical paper making machine is quite high. The high machine hall length poses a problem where the paper making machine must be installed in a building having the required amount of floor area, but where the floor area is divided among multiple levels or floors. Thus, the machine may not be able to fit on the designated level and the cost of modifying the existing building to accommodate the machine may be very expensive. In addition, if a new building was to be built to accommodate the machine, the large footprint of typical paper making machines would add significant cost to the building since the cost per linear foot of machine hall length is usually quite high. Thus, it is generally disadvantageous in terms of cost to have a paper making machine with a large footprint.

Another disadvantage of prior art paper making machines is that, where the cleaning section is disposed above the drying section, the paper web is usually transported from the web-receiving section to the nip in an inverted web run. The inverted web run does not allow the fabric to support the web and thus may lead to the possibility of the web falling off the fabric as it is being transported. In addition, elaborate catch pans and measures to prevent condensation must be implemented to prevent cleaning water from dripping from the cleaning section onto the underlying drying section in paper making processes involve special fabrics, such as TAD fabrics or other texturing fabrics used in tissue manufacturing which typically have an open structure and are more sensitive to water drip.

Thus, it would be desirable to provide a paper making machine configured such that the machine is compact and has a relatively small footprint in order to reduce the costs associated with housing the machine. In addition, it would be desirable to provide a paper making machine configured such that the paper web is transported on the fabric and through the drying section to the nip on an upper surface of the fabric, in order for the fabric to support the web and lessen the possibility of the web falling therefrom. Further, it would be desirable to provide a paper making machine configured such that the cleaning section is not located above the drying section, thus obviating the need for elaborate means for preventing the cleaning water from dripping from the cleaning section onto the underlying drying section.

SUMMARY OF THE INVENTION

The above and other needs are met by the present invention which, in one embodiment, provides a compact multilevel paper making machine comprising a web-receiving region where a web of paper is received on a fabric forming a continuous loop, a reel-up for winding the paper web onto a roll, and a web transfer point disposed between the web-receiving region and the reel-up. The fabric receives the web at the web-receiving region and then supports and transports the web from the web-receiving region to the web transfer point in a first direction on a first defined vertical level. At the web transfer point, the web is separated from the fabric. Following separation from the fabric, the web is transported to the reel-up in a second direction, generally opposite to the first direction, and on a second defined vertical level different from the first defined vertical level. The second defined vertical level may be either vertically above or below the first defined vertical level, wherein a defined vertical level may comprise, for instance, a floor of a building. Thus, by configuring the paper making machine to transport the web between different defined vertical levels, a compact multilevel paper making machine having a small footprint is provided for limited-space installations.

In accordance with certain embodiments of the present invention, the paper making machine may further comprise a dewatering section and/or a drying section, the drying section comprising at least one non-compacting dryer, disposed between the web-receiving region and the web transfer point such that the web-receiving region and the dewatering section and/or the drying section are disposed on the first defined vertical level.

In alternate embodiments of the paper making machine according to the present invention, the paper making machine may further comprise a drying section, the drying section including a Yankee dryer disposed between the web transfer point and the reel-up such that the Yankee dryer and the reel-up are disposed on the second defined vertical level.

Further alternate embodiments of the paper making machine according to the present invention may comprise a dewatering section and/or a pre-drying section, the pre-drying section comprising at least one non-compacting dryer, disposed between the web-receiving region and the web transfer point such that the web-receiving region and the dewatering section and/or the pre-drying section are disposed on the first defined vertical level, and a drying section, typically comprising a Yankee dryer, disposed between the web transfer point and the reel-up such that the Yankee dryer and the reel-up are disposed on the second defined vertical level.

It will further be appreciated that embodiments of the present invention which locate machine components on different defined vertical levels, with one of the defined vertical levels being disposed vertically over the other, provide multilevel layouts of a paper making machine, thereby reducing the footprint of the machine and resulting in a more compact installation thereof. The compact installation with reduced footprint of the machine thereby reduces the machine hall cost. It will be recognized, therefore, that the invention facilitates the achievement of a number of distinct advantages over prior art paper making devices.

Thus, it will be appreciated that embodiments of the present invention enable a wet paper web to be supported on an upper surface of a continuous fabric, wherein the web is carried on the fabric through dryers and/or other water-removing devices in such a way that the web will not fall off the fabric and such that the cleaning section is not located above any part of the web. Accordingly, there is no need for elaborate means for preventing the cleaning water from dripping from the cleaning section onto the web, as is necessary in prior art paper making processes employing a cleaning section above the drying section. The elimination of the possibility of cleaning water dripping onto the fabric and web is especially advantageous in paper making machines employing special texturing fabrics or through-air drying fabrics.

BRIEF DESCRIPTION OF THE DRAWINGS

Some of the advantages of the present invention having been stated, others will appear as the description proceeds, when considered in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
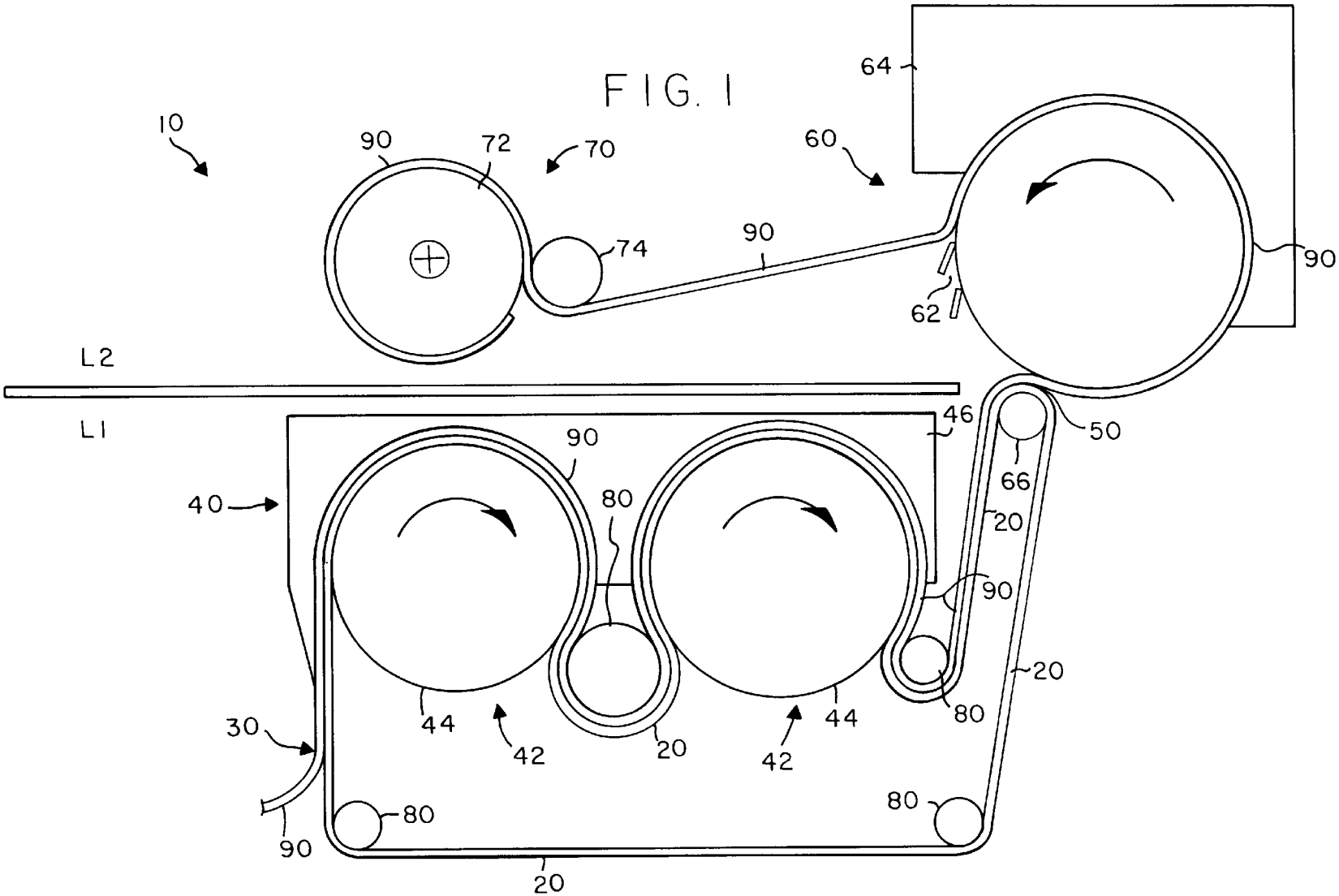
FIGS. 1–3 are schematic representations illustrating several alternative embodiment of the present invention having a web-receiving region and a pre-drying section on a first defined vertical level and a Yankee dryer and a reel-up on a second defined vertical level.

FIG. 1 discloses one embodiment of an apparatus for drying a wet web of paper, more particularly a paper making machine, indicated generally by the numeral 10, which includes the features of the present invention. The paper making machine 10 generally comprises a drying fabric 20, a web-receiving region 30, a pre-drying section 40, a web transfer point 50, a Yankee dryer 60, and a reel-up 70.

The drying fabric 20 forms an endless loop between the web-receiving region 30, the pre-drying section 40, and the web transfer point 50. The fabric loop 20 may also have a plurality of turning rolls 80 disposed around the loop 20 in order to guide the fabric 20. The web-receiving region 30 is the point about the loop at which a wet paper web 90 is transferred onto the fabric 20. The wet paper web 90 is typically formed in a forming section (not shown) by a former (not shown), by various methods which are well known in the art. Such formers include, for example, a modified Crescent former wherein the web 90 is formed between a pair of forming fabrics, in which case, the web 90 typically is transferred from one of the forming fabrics onto the drying fabric 20 at the web-receiving region 30 thereof. Alternatively, the web 90 may be formed on the drying fabric 20 such that the web 90 is not actually "transferred" onto the drying fabric 20. Nevertheless, references herein to the wet paper web 90 being transferred to or received by the fabric 20 are intended to include either of the above-described types of machines.

The fabric 20 receives and transports the web 90 to the pre-drying section 40 having at least one dryer 42 for partially drying the wet web 90. In order to produce a web 90 which is soft and absorbent, yet strong, while also using a minimum of paper fiber, a non-compacting dryer preferably is used. Typical non-compacting dryers include through-air dryers, infrared dryers, impingement dryers, and cylindrical contact dryers. Where the pre-drying section utilizes through-air dryers, the through-air dryers may be, for example, flat bed dryers, rotary roll dryers with inward air flow, or rotary roll dryers with outward air flow. Through-air dryers also generally include a ventilation hood covering the travel path of the web. It should be understood, however, that the present invention is not limited to machines employing non-compacting dryers, but can also include machines employing a press-type dryer instead of, or in addition to, a non-compacting dryer. It should also be understood that the term "pre-drying section" is intended to refer to paper making machines having a subsequent dryer, such as a Yankee dryer, following the "pre-drying section" and comprising the final dryer for the web. Where the paper making machine does not include a subsequent dryer, the "pre-drying section" is more aptly termed the "drying section" since it then comprises the final dryer for the web. Note further that, in some instances, the paper making machine may also include a dewatering section (not shown) between the web-receiving region and the predrying/drying section for dewatering the web before the web is transported to the dryers.

Accordingly, the embodiment of the present invention shown in FIG. 1 includes a pre-drying section 40 comprising two rotary through-air dryers 42 and a turning roll 80 disposed therebetween. At least one turning roll 80 is used between successive dryers 42 in a pre-drying section 40 having multiple dryers 42 in order to keep the web 90 in the proper orientation with respect to the dryers 42. The through-air dryer 42 generally comprises a rotatable porous cylinder 44 and a ventilation hood 46. The ventilation hood 46 generally covers the portion of the surface of the porous cylinder 44 about which the web 90 is wrapped. Where multiple through-air dryers 42 are used in a drying section 40, the through-air dryers 42 may share a common ventilation hood 46. Further, the ventilation hood 46 may be constructed as a one piece assembly or may be formed in at least two pieces which are movable away from the porous cylinder 44 to permit access thereto.

Another aspect of the through-air dryer 42 is that, depending on the configuration of the machine 10 and the orientation of the web 90 with respect to the fabric 20 moving through the through-air dryer 42, the through-air dryer 42 may be configured to blow air inward from outside the cylinder or to blow air outward from inside the cylinder. A through-air dryer 42 configured to blow air inward from outside the cylinder, as illustrated in FIG. 1, is preferred where the fabric 20 contacts the porous cylinder 44 and the web 90 lies outside the fabric 20.

Although the fabric 20 carries the web 90 in a circuitous route around the through-air dryers 42 in the pre-drying section 40, the web 90 is transported generally on the upper surface of the fabric 20 from the web-receiving region 30 to the web transfer point 50. Thus, since the web 90 is continuously supported by the fabric 20, the risk of the web 90 falling off or separating from the fabric 20 is reduced as compared to prior art paper making machines having inverted web runs.

Once the web 90 is transported through the pre-drying section 40 on a first defined vertical level L1 and partially dried, it is transported by the fabric 20 to the web transfer point 50 where it is separated from the fabric 20 and directed onto to the Yankee dryer 60 on a second defined vertical level L2. The defined vertical levels L1 and L2 may comprise, for instance, separate floors of a building or other like situations where certain components of the machine 10 are separated on different levels. The Yankee dryer 60 is a large diameter drum internally heated with steam to provide a hot surface for completing the drying of the web 90. The Yankee dryer 60 typically is also employed to shorten the web 90 in the machine direction, i.e. in a lengthwise manner, so as to make it thicker, bulkier, and extensible in the machine direction. This process is known as creping and is accomplished by a doctor blade 62 that, on removal of the web 90 from the Yankee dryer 60, creates a multitude of microfolds extending in the cross-machine direction. The Yankee dryer 60 further includes a hood 64 partially surrounding the Yankee dryer 60, along the portion about which the web 90 is wrapped. Engaged against the Yankee dryer 60 is a transfer roll 66, forming the web transfer point 50 therebetween, through which passes the fabric 20 carrying the partially dried web 90. The transfer roll 66 presses the web 90 against the Yankee dryer 60 such that the web 90 is transferred to the Yankee dryer 60 from the fabric 20. Once transferred to the Yankee dryer 60, the web 90 is further dried and is then creped from the Yankee dryer 60 by the doctor blade 62.

Note that in the configuration of a paper making machine 10, the Yankee dryer 60 must rotate in the direction opposite to the travel of the fabric loop 20 in order for the fabric 20 and the web 90 to be passed through the web transfer point 50. Accordingly, the Yankee dryer 60 is placed such that it carries the web 90 over the top of the Yankee dryer 60 to the doctor blade 62 in generally the opposite direction to which the web 90 traveled through the pre-drying section 40. In some embodiments, the described configuration may facilitate an increase in the wrap area of the web 90 about the Yankee dryer 60 and thereby result in a corresponding increase in drying efficiency. As the web 90 is creped and separated from the Yankee dryer 60 by the doctor blade 62, it is directed to the reel-up 70, also disposed on the second defined vertical level L2. The reel-up 70 generally comprises a spool 72 forming a nip with a drum 74 wherein the web 90 is forwarded therebetween and wound onto the spool 72. The web 90 may run in a free draw (unsupported) between the Yankee dryer 60 and the reel-up 70 or may be supported by a supporting structure (not shown) such as, for example, active air foils. However, the reel-up 70 may be configured in any manner suitable for receiving and gathering the web 90 consistent with the spirit and scope of the present invention. Thus, an advantage provided by embodiments of the present invention having components of the machine 10 separated between different defined vertical levels L1 and L2, with one of the defined vertical levels being disposed vertically above the other, is that multilevel layouts of a paper making machine 10 are possible, thereby reducing the footprint of the machine 10 and resulting in a more compact installation thereof.

At the web transfer point 50, the fabric 20 has completed transporting the web 90 from the web-receiving region 30 to the Yankee dryer 60. However, since the fabric 20 forms a continuous loop, it must then return to the web-receiving region 30 once it exits the web transfer point 50. Since the fabric 20 has already carried a portion of the paper web 90 through the pre-drying section 40 to the web transfer point 50, it must be cleaned of any residue left thereon by the paper web 90 before returning to the web-receiving region 30. Accordingly, a cleaning section (not shown) is disposed along the return run of the fabric loop 20 such that the cleaning section is not above any portion of the web 90 and, particularly, is not above the pre-drying section 40, such that the fabric 20 may be cleaned without cleaning water dripping onto the fabric 20 and the web 90 traveling through the pre-drying section 40. Thus, as the fabric 20 exits the web transfer point 50, it travels through the cleaning section which generally comprises a device for washing the fabric 20 such as a shower (not shown) and a device for drying the fabric 20 such as a vacuum box (not shown). However, some special types of paper making processes involve special fabrics, such as TAD fabrics or other texturing fabrics used in tissue manufacturing which typically have an open structure and which also require cleaning through the entire thickness of the fabric, that require special and often complicated cleaning equipment. Further, the cleaning section may also comprise a plurality of cleaning stations for cleaning the fabric 20. In addition, the cleaning stations in the cleaning section may be disposed in any orientation consistent with the operation of the specific cleaning equipment used and the travel path of the fabric 20.

After the fabric 20 is cleaned in the cleaning section or sections, it completes the loop by returning to the web-receiving region 30 to begin the cycle anew. Thus, another advantage provided by embodiments of the present invention having the cleaning section disposed below the drying section 40 is that elaborate catch pans and measures to prevent condensation are not necessary to prevent cleaning water from the cleaning section from dripping onto the drying section 40, whereas such measures are needed with prior art paper making machines having the cleaning section disposed above the drying section.

Figure 2:
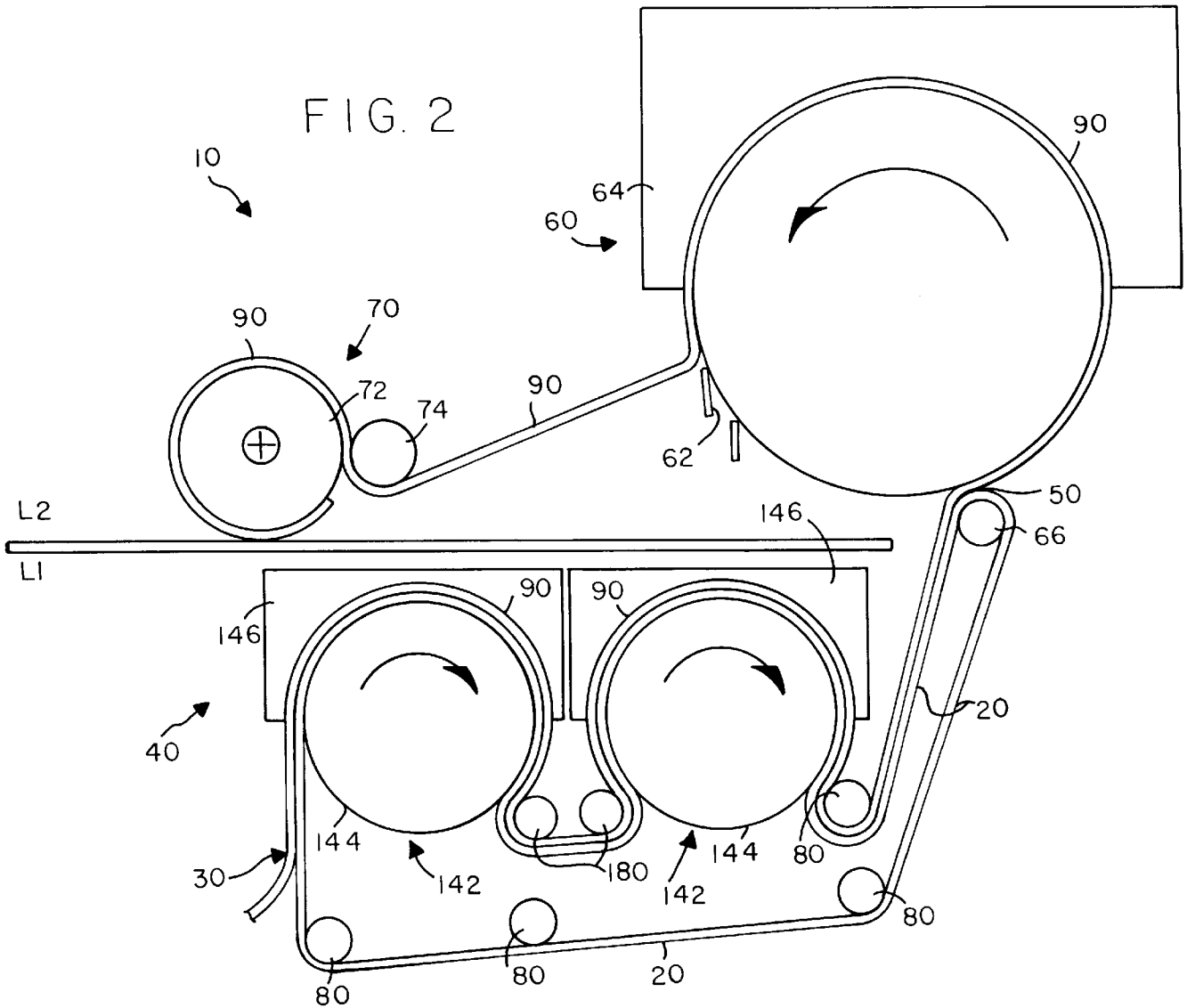

FIG. 2 shows an alternate embodiment of the present invention having two turning rolls 180 between successive through-air dryers 142. This configuration, as with the configuration shown in FIG. 1, keeps the web 90 on an upper surface of the fabric 20 through the pre-drying section 40. Further, this embodiment shows the through-air dryers 142 each having an individual ventilation hood 146. The ventilation hoods 146 may each be constructed as a one piece assembly or may be formed in at least two pieces which are movable away from the porous cylinders 144 to permit access thereto.

Figure 3:
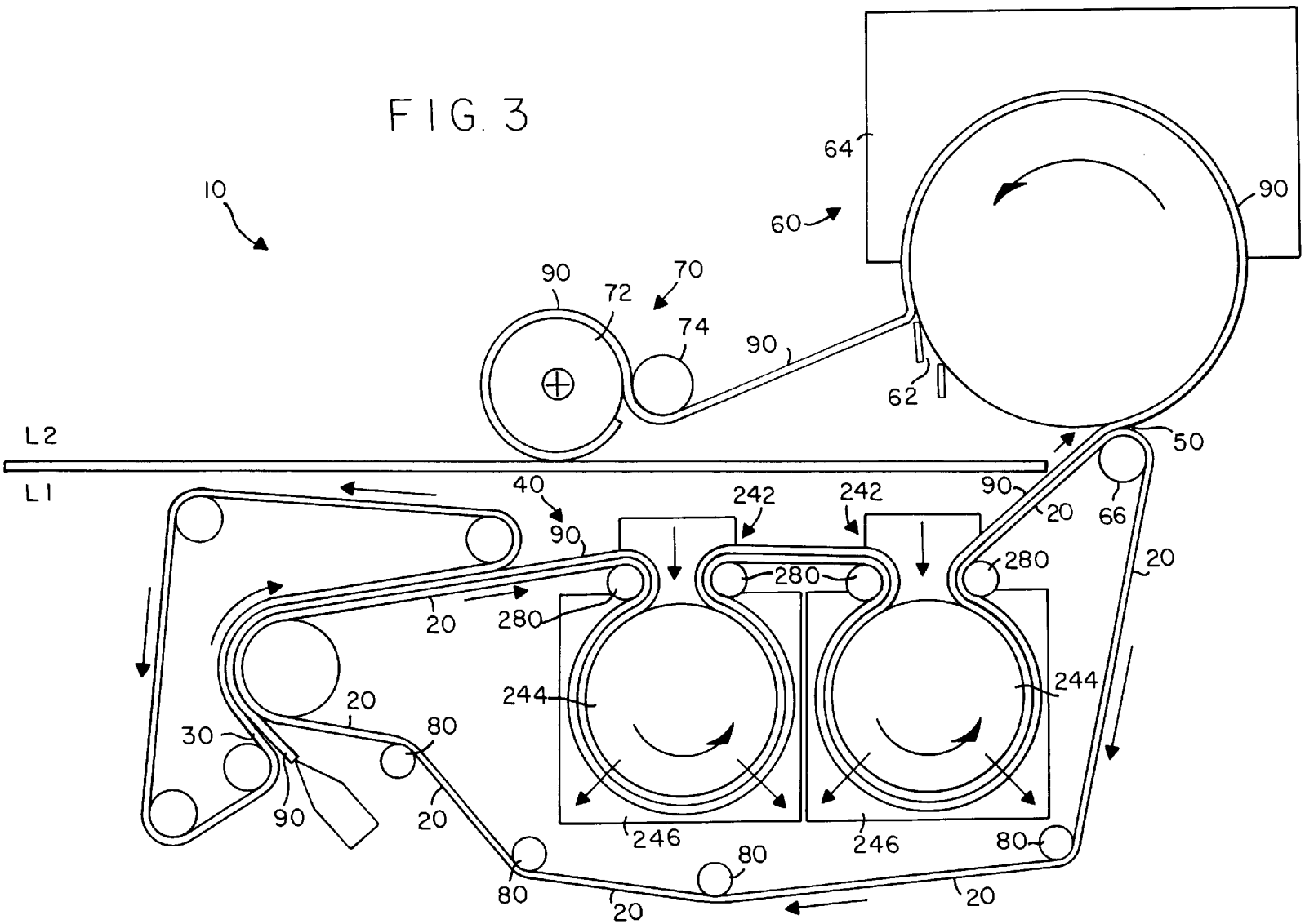

FIG. 3 shows an alternate embodiment of the present invention where the fabric 20 lies outside the web 90 and the web 90 itself contacts the porous cylinders 244 of the through-air dryers 242 in the pre-drying section 40. In this embodiment, it is preferred to have outward airflow from inside the cylinder and the through-air dryers 242 are configured accordingly. Further, this embodiment shows the through-air dryers 242 each having an individual ventilation hood 246, with the hoods 246 located below the porous cylinders 244. The ventilation hoods 246 may each be constructed as a one piece assembly or may be formed in at least two pieces which are movable away from the porous cylinders 244 to permit access thereto. In addition, this embodiment includes two turning rolls 280 between successive through-air dryers 242. Two further turning rolls 280 are provided at both the entrance into and the exit from the through-air dryers 242 to guide the fabric 20 around the dryers 242 without the fabric 20 contacting the ventilation hoods 246.

Figure 4:
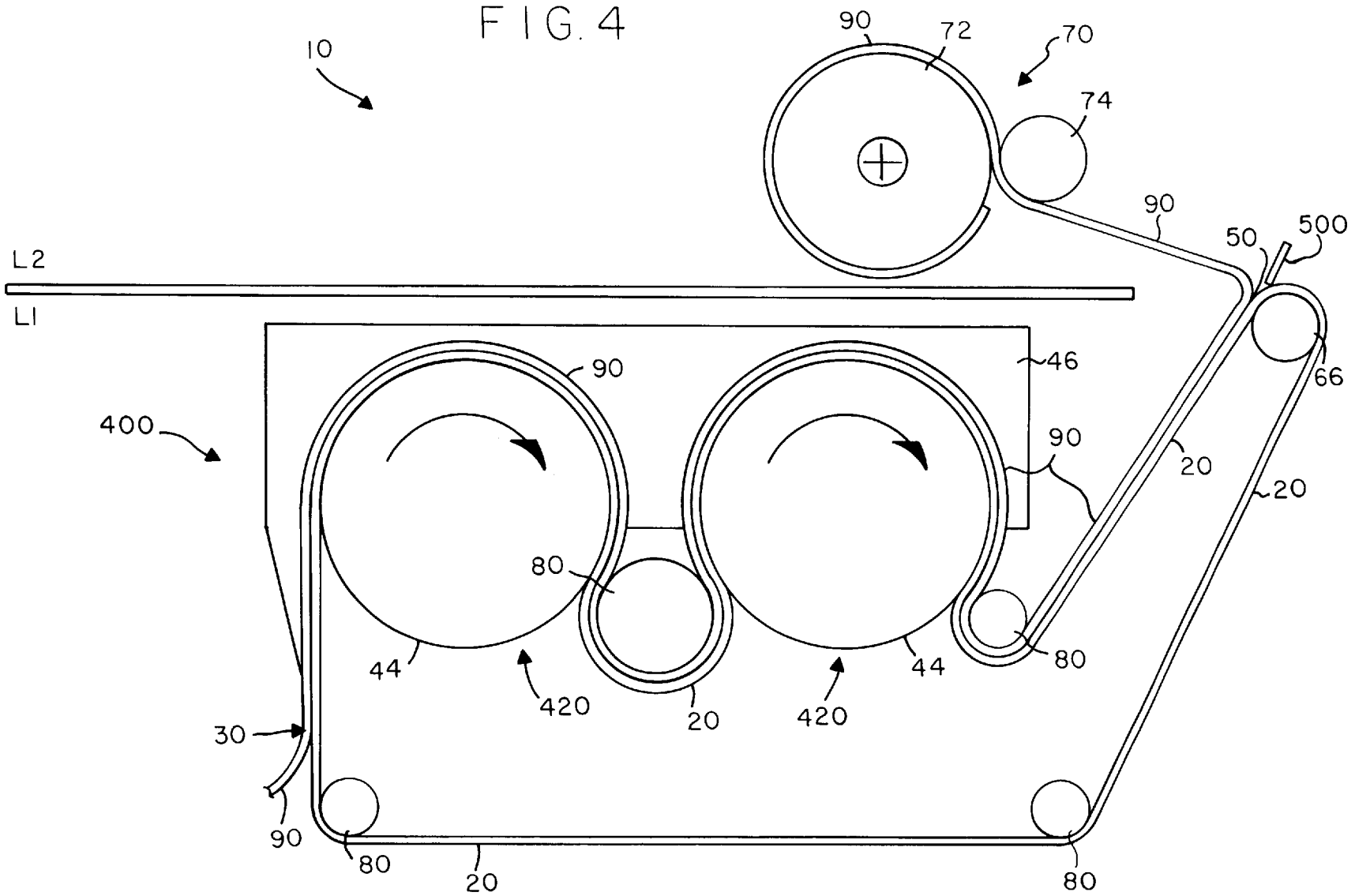
FIGS. 4–6 are schematic representations illustrating still further alternative embodiments of the present invention having a web-receiving region and a drying section on a first defined vertical level and a reel-up on a second defined vertical level.
Figure 5:
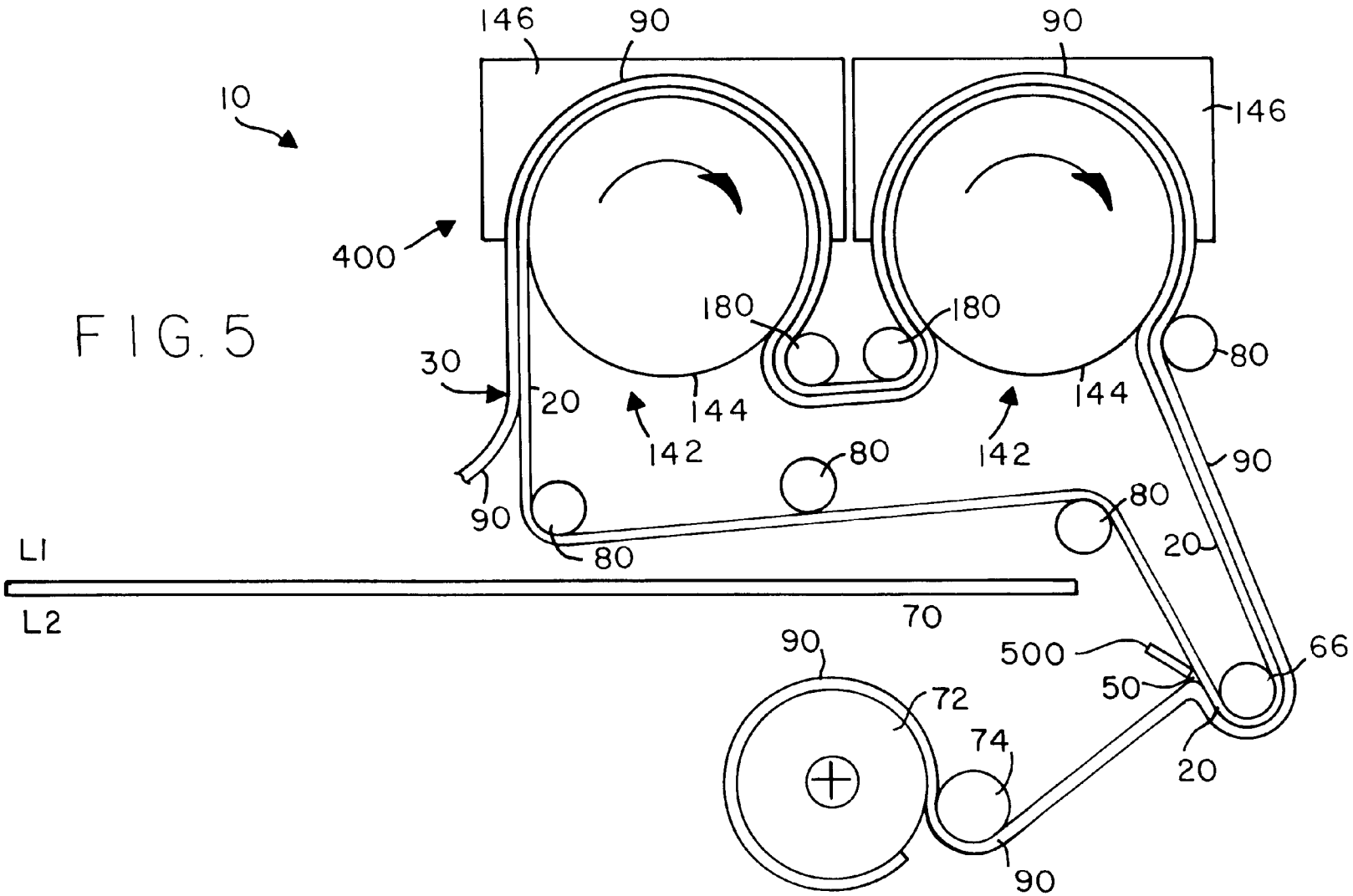
Figure 6:
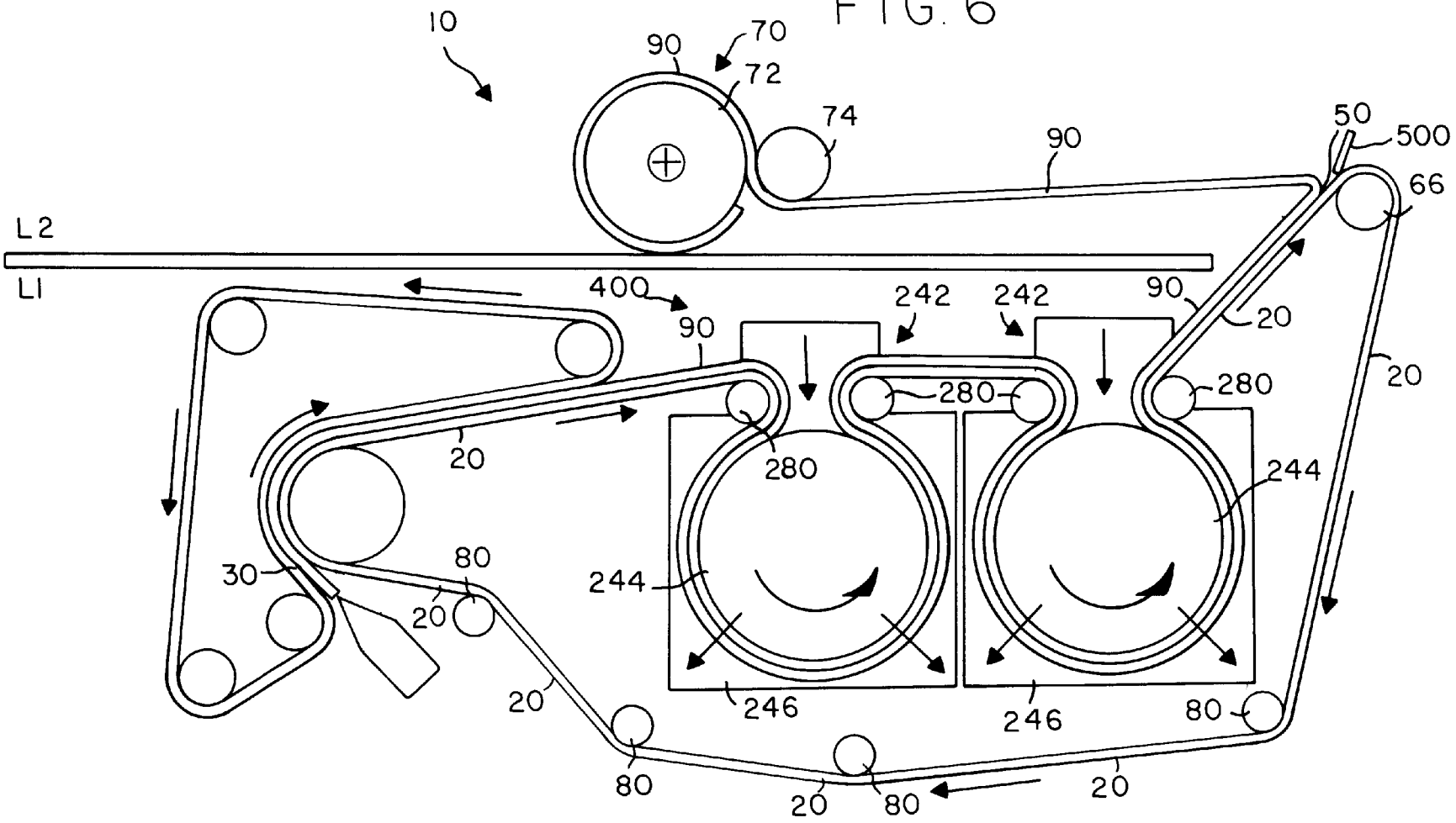

FIGS. 4–6 show several alternate embodiments of the present invention similar to the embodiments shown in FIGS. 1–3, respectively, but wherein a Yankee dryer is not used in the paper making machine 10. Accordingly, the "pre-drying" section 40 previously shown in FIGS. 1–3 is now more aptly termed the "drying section" 400 and the dryers 420 therein now comprise the final dryers 420 for the web 90. In addition, the web 90 is now separated from the fabric at the web transfer point 50 by, for example, a doctor blade or air knife, indicated by the numeral 500. FIG. 4 shows an alternate embodiment (without a Yankee dryer) to the embodiment shown in FIG. 1. Accordingly, this embodiment of the invention similarly has the web-receiving region 30 and the drying section 400 disposed on the first defined vertical level L1 and the reel-up 70 disposed on the second defined vertical level L2, wherein the second defined vertical level L2 is disposed above the first defined vertical level L1. FIG. 5 shows an alternate embodiment to the embodiment shown in FIG. 2, but without the Yankee dryer and with the second defined vertical level L2 disposed below the first defined vertical level L1. FIG. 6 shows an alternate embodiment (without a Yankee dryer) to the embodiment shown in FIG. 3 with the second defined vertical level L2 disposed above the first defined vertical level L1.

Figure 7:
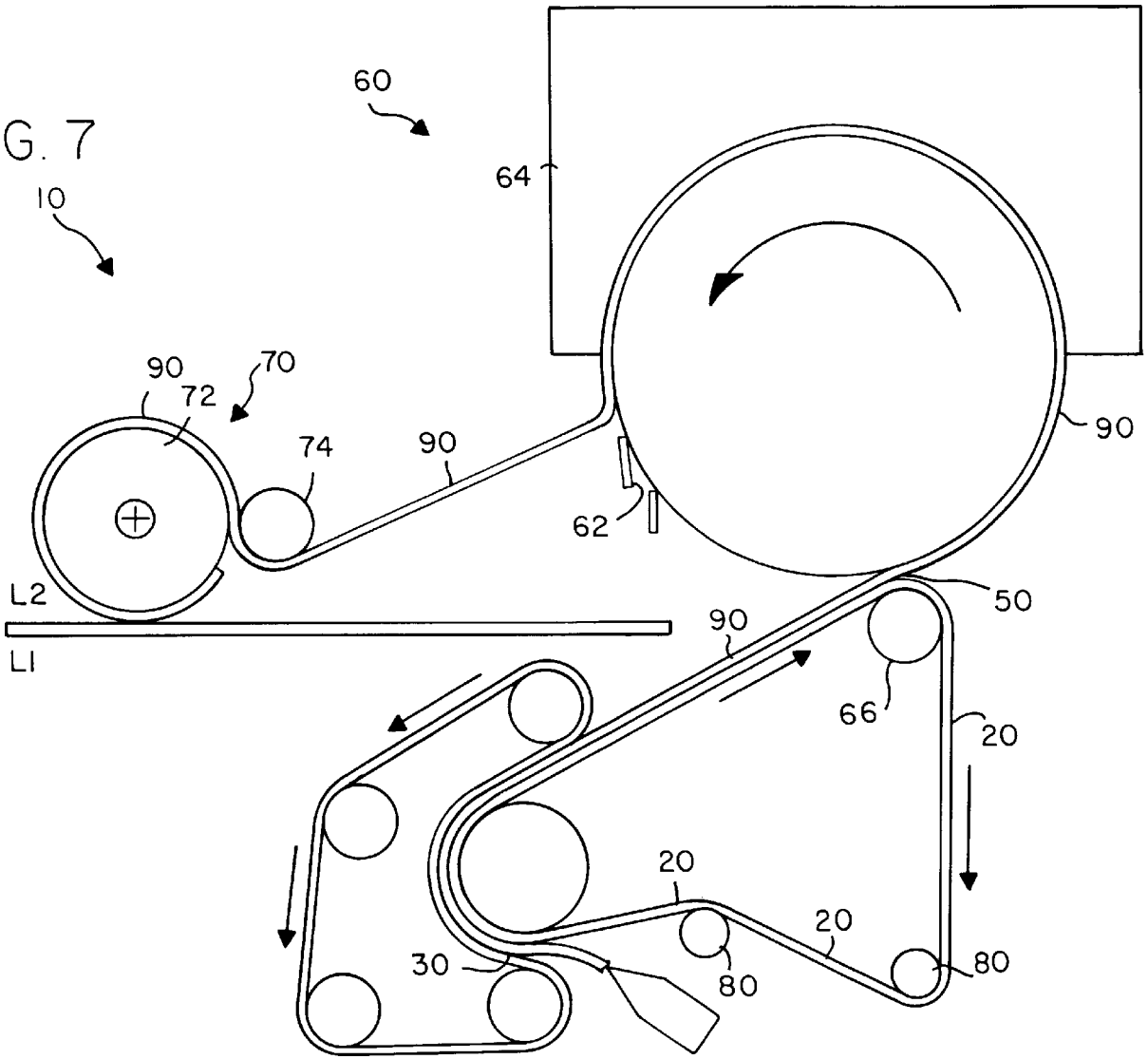
FIG. 7 is a schematic representation illustrating yet another alternative embodiment of the present invention having a web-receiving region on a first defined vertical level and a Yankee dryer and a reel-up on a second defined vertical level.

FIG. 7 shows another alternate embodiment to the embodiment shown in FIG. 3. As shown, this embodiment of the invention omits the pre-drying section such that only the Yankee dryer 60 is provided for drying the web 90. According to this embodiment of the invention, the web-receiving region 30 is disposed on the first defined vertical level L1 while the Yankee dryer 60 and the reel-up 70 are disposed on the second defined vertical level L2, wherein the second defined vertical level L2 is disposed above the first defined vertical level L1. In some embodiments, the web 90 may be partially dewatered following the web-receiving region 30 and prior to the web transfer point 50.

Thus, embodiments of the present invention advantageously provide a paper making machine having components of the machine separated between different defined vertical levels, with one of the defined vertical levels being disposed vertically over the other thereby providing multilevel layouts of a paper making machine which reduce the footprint of the machine, result in a more compact installation thereof, and provides a reduction in machine hall cost. Another advantage provided by embodiments of the present invention is that the wet paper web is supported on an upper surface of a continuous fabric through dryers and/or other water-removing devices, wherein the fabric is cleaned after the web is separated from the fabric such that the cleaning section is not located above any part of the web. Accordingly, there is no need for elaborate means for preventing the cleaning water from dripping from the cleaning section onto the web, especially in paper making machines employing special texturing fabrics or through-air drying fabrics.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A compact multilevel tissue paper making machine for manufacturing a web of tissue paper, said machine consisting of:

a twin wire former for forming a paper web;

a Yankee dryer for drying the web;

a reel-up for receiving the web from the Yankee dryer and for winding the web onto a roll; and a fabric forming a continuous loop and configured to receive the web directly from the twin wire former at a web-receiving region, the fabric being further configured to support and transport the web from the web-receiving region to a web transfer point on an upper surface of the fabric in a first direction on a first defined vertical level, the web being separated from the fabric at the web transfer point and transferred directly to the Yankee dryer, the web then being transported from the Yankee dryer to the reel-up in a second direction generally opposite to the first direction and on a second defined vertical level, one of the defined vertical levels being disposed vertically over the other.

2. A paper making machine according to claim 1 wherein the first defined vertical level is above the second defined vertical level.

3. A paper making machine according to claim 1 wherein the first defined vertical level is below the second defined vertical level.

4. A compact multilevel tissue paper making machine for manufacturing a web of tissue paper, said machine consisting of:

a twin wire former for forming a paper web;

a drying section having a non-compacting dryer configured to finally dry the web;

a reel-up for winding the web onto a roll; and a fabric forming a continuous loop and configured to receive the web formed in the twin wire former at a web-receiving region, the fabric being further configured to support and transport the web from the web-receiving region through the drying section and then to a web transfer point on an upper surface of the fabric in a first direction on a first defined vertical level, the web being separated from the fabric at the web transfer point and transported to the reel-up in a second direction generally opposite to the first direction and on a second defined vertical level, one of the defined vertical levels being disposed vertically over the other.

5. A paper making machine according to claim 4 wherein the first defined vertical level is above the second defined vertical level.

6. A paper making machine according to claim 4 wherein the first defined vertical level is below the second defined vertical level.

7. A compact multilevel tissue paper making machine for manufacturing a web of tissue paper, said machine consisting of:

a twin wire former for forming a paper web;

a pre-drying section having a non-compacting dryer for partially drying the web;

a Yankee dryer for drying the partially dried web;

a reel-up for receiving the web from the Yankee dryer and for winding the web onto a roll; and a single fabric forming a continuous loop and configured to receive the web formed in the twin wire former at a web-receiving region, the fabric being further configured such that only the single fabric supports and transports the web from the web-receiving region through the pre-drying section and then to a web transfer point on an upper surface of the fabric in a first direction on a first defined vertical level, the web being separated from the fabric at the web transfer point and being transferred directly to the Yankee dryer, the web thereafter being transported from the Yankee dryer to the reel-up in a second direction generally opposite to the first direction and on a second defined vertical level, one of the defined vertical levels being disposed vertically over the other.

8. A paper making machine according to claim 7 wherein the first defined vertical level is above the second defined vertical level.

9. A paper making machine according to claim 7 wherein the first defined vertical level is below the second defined vertical level.

* * * * *